US010174257B2

(12) United States Patent
Hill et al.

(10) Patent No.: US 10,174,257 B2
(45) Date of Patent: Jan. 8, 2019

(54) COOLER FOR CARBON-BASED FEEDSTOCK PROCESSING SYSTEM

(71) Applicant: Clean Energy Technology Association, Inc., Fairfield, TX (US)

(72) Inventors: Roy W. Hill, Fairfield, TX (US); Jerry Scott Long, Fairfield, TX (US); Tracy Thompson, Fairfield, TX (US)

(73) Assignee: CLEAN ENERGY TECHNOLOGY ASSOCIATION, INC., Houston, TX (US)

( * ) Notice: Subject to any disclaimer, the term of this patent is extended or adjusted under 35 U.S.C. 154(b) by 801 days.

(21) Appl. No.: 14/602,824

(22) Filed: Jan. 22, 2015

(65) Prior Publication Data

US 2016/0215219 A1 Jul. 28, 2016

(51) Int. Cl.

| | |
|---|---|
| ***C10B 39/02*** | (2006.01) |
| ***C10B 39/12*** | (2006.01) |
| ***F28F 5/06*** | (2006.01) |
| ***F27D 15/02*** | (2006.01) |
| ***F28D 7/12*** | (2006.01) |
| ***F28F 1/36*** | (2006.01) |

(52) U.S. Cl.

CPC ..... *C10B 39/02* (2013.01); *C10B 39/12* (2013.01); *F27D 15/02* (2013.01); *F28D 7/12* (2013.01); *F28F 1/36* (2013.01); *F28F 5/06* (2013.01)

(58) Field of Classification Search

CPC . C10B 39/02; C10B 39/12; F28D 7/12; F28D 5/06; F28D 19/00; F28D 19/041; F27D 15/02; B01F 15/068; B01F 2015/061; B01F 7/007; F25D 25/04; F25D 3/11; F25D 13/067; F25D 13/06

See application file for complete search history.

(56) References Cited

U.S. PATENT DOCUMENTS 1,538,796 A * 5/1925 Gorden ..... C10B 7/10 202/106
1,810,828 A * 6/1931 Hayes ..... C10B 7/10 201/33
2,182,556 A * 12/1939 Griswold ..... A23B 7/0408 165/109.1
2,973,306 A * 2/1961 Chick ..... C10B 47/44 201/1
4,003,717 A * 1/1977 Cass ..... B01J 2/10 159/25.1
4,028,040 A * 6/1977 Waltrip ..... C10L 5/02 425/222
4,094,769 A * 6/1978 Brown ..... C10B 47/44 201/33

(Continued)

*Primary Examiner* — Orlando E Aviles Bosques
*Assistant Examiner* — Jose O Class-Quinones
(74) *Attorney, Agent, or Firm* — Bracewell LLP; Albert B. Kimball; Kevin R. Tamm

(57) ABSTRACT

A cooler for cooling product pursuant to a distillation process, including a first substantially enclosed housing with an inlet proximate a first end for receiving product from a distillation unit, and an outlet proximate a second end for discharging cooled product, and a first auger substantially enclosed within the housing for driving the product from the inlet to the outlet, the auger having a helical blade circumscribing a perforated central hollow shaft for transmitting cooled gas into the housing to help cool product within the housing.

1 Claim, 5 Drawing Sheets

(56) References Cited

U.S. PATENT DOCUMENTS 4,176,082 A * 11/1979 West ..... A23B 4/0523
99/473
4,330,946 A * 5/1982 Courneya ..... F26B 3/347
219/686
4,686,008 A * 8/1987 Gibson ..... C10B 7/10
201/33
5,176,087 A * 1/1993 Noland ..... B09C 1/06
110/229
5,314,012 A * 5/1994 Mosse ..... F28C 3/12
165/111
5,802,961 A * 9/1998 Hay ..... A23B 7/0053
165/111

* cited by examiner

COOLER FOR CARBON-BASED FEEDSTOCK PROCESSING SYSTEM

BACKGROUND OF THE INVENTION

1. Field of the Invention

The present invention relates to processing carbon-based feedstock, and in particular to a cooler for cooling product after it exits a distillation chamber.

2. Description of the Related Art

Coal is an abundant natural resource capable of exploitation to produce large amounts of energy. Coal in its raw form, however, usually contains undesirable compositions in the form of a number of other chemical compositions or elements. One problem faced in the coal industry is that traditional means of extracting energy from coal have been the subject of concerns, due to possible adverse environmental consequences because of the undesirable compositions usually present in raw coal. For example, historically coal has been burned to create heat, such as to turn water into steam to power a turbine and generate electricity. This process generates large amounts of gaseous emissions containing small amounts of the undesirable compositions which harm the environment. As a result, the use of coal as an energy source can cause tension between the need for an economic way to produce energy on the one hand, and environmental concerns on the other.

During a typical coal processing operation, coal and other carbon-based products are often subjected to distillation processes in order to extract various products therefrom. Typically, the distillation process involves heating a coal feedstock in the absence of oxygen as the feedstock is moved through the distillation chamber, leading to the conversion of the feedstock into useful product.

When the product leaves the distillation chamber, it is typically very hot. Thus, the product must be cooled in order to further process or package the product. To accomplish this cooling, numerous techniques are used in the industry, each having shortcomings. For example, some coolers use glycol, or other cooling fluid, circulated through and enclosed in the fins of an auger that pulls the feedstock through the cooler. Such a cooler, however, is exceedingly expensive to manufacture and operate. In addition, some prior art coolers vibrate to move the feedstock through a cooling chamber while cool gas is blown in one end of the chamber. This type of cooler, however, is unsuited to many types of feedstock, however, because the air moving through the chamber combined with the agitation of the feedstock created too much dust.

SUMMARY OF THE INVENTION

Briefly, the present invention provides a cooler for cooling product pursuant to a distillation process. The cooler includes a first substantially enclosed housing with an inlet proximate a first end for receiving product from a distillation unit, and an outlet proximate a second end for discharging cooled product, as well as a first auger substantially enclosed within the housing for driving the product from the inlet to the outlet, the auger having a helical blade circumscribing a perforated central hollow shaft for transmitting cooled gas into the housing to help cool product within the housing.

In some embodiments, the cooler may include a first exhaust port attached to the housing to exhaust gases from within the housing to a location outside the housing. In addition, the housing may have hollow walls for circulating cooling fluid so that the housing acts as a heat exchanger to help cool product within the housing.

In alternate embodiments, the cooler may further include a second substantially enclosed housing with an inlet proximate a first end for receiving product from the first substantially enclosed housing, and an outlet proximate a second end for discharging cooled product, and a second auger substantially enclosed within the second substantially enclosed housing for driving the product from the inlet to the outlet, the second auger having a helical blade circumscribing a perforated central hollow shaft for transmitting cooled gas into the second substantially enclosed housing to help cool the product within the housing.

Furthermore, the cooler may include a second exhaust port attached to the second substantially enclosed housing to exhaust gases from within the second substantially enclosed housing to a location outside the second substantially enclosed housing. In addition, the second substantially enclosed housing can have hollow walls for circulating cooling fluid so that the second substantially enclosed housing acts as a heat exchanger to help cool product within the second substantially enclosed housing.

Another embodiment of the invention provides an apparatus for cooling product. The apparatus includes first and second cooling chambers connected so that product can pass from the first cooling chamber to the second cooling chamber. In addition, the apparatus includes first and second augers, positioned within the first and second chambers, respectively, each auger having a helical blade for driving product through a respective cooling chamber, each helical blade surrounding a perforated hollow shaft that transmits cool gas into the respective chamber through the shaft.

In some embodiments, the first and second cooling chambers can each have hollow walls through which coolant is passed so that the first and second cooling chambers act as heat exchangers, thereby helping to cool product within the first and second chambers. In addition, the apparatus can further include an exhaust port in each of the first and second chambers to permit gas to escape from the first and second chambers to a location outside of the first and second chambers.

Yet another embodiment of the invention provides a process for cooling product after the product exits a distillation unit. The process includes the steps of inserting the product into a first chamber enclosed by a first cooler housing, driving the product through the first cooler housing with a first auger having a helical blade circumscribing a perforated hollow shaft, injecting cool gas into the first chamber through the perforated hollow shaft of the first auger to mix with the product in the first chamber, and discharging the cooled product from the first chamber.

In some embodiments, the process may further include venting gas from within the first chamber in the first cooler housing through a first exhaust port attached to the first cooler housing, cooling the gas after it exits the first exhaust port, and recirculating the cooled gas back into the first chamber through the perforated hollow shaft of the first auger to mix with the product in the first chamber. In addition, the process may include circulating cooling fluid through walls of the first cooler housing so that the first cooler housing acts as a heat exchanger and helps to cool product in the first chamber of the first cooler housing.

In certain embodiments, the process may include discharging the fluid from the walls of the first cooler housing, cooling the fluid, and recirculating the cooled fluid back through the walls of the first cooler housing so that the first cooler housing acts as a heat exchanger and helps to cool product in the first chamber of the first cooler housing. Furthermore, the process may include inserting the product into a second chamber enclosed by a second cooler housing, driving the product through the second cooler housing with a second auger having a helical blade circumscribing a perforated hollow shaft, injecting cool gas into the second chamber through the perforated hollow shaft of the second auger to mix with the product in the second chamber, and discharging the cooled product from the second chamber.

In still further embodiments, the process may include the steps of venting gas from within the second chamber in the second cooler housing through a second exhaust port attached to the second cooler housing, cooling the gas after it exits the second exhaust port, and recirculating the cooled gas back into the second chamber through the perforated hollow shaft of the second auger to mix with the product in the second chamber, as well as circulating cooling fluid through walls of the second cooler housing so that the second cooler housing acts as a heat exchanger and helps to cool product in the second chamber of the second cooler housing.

An alternative embodiment of the process contemplates discharging the fluid from the walls of the second cooler housing, cooling the fluid, and recirculating the cooled fluid back through the walls of the second cooler housing so that the second cooler housing acts as a heat exchanger and helps to cool product in the second chamber of the second cooler housing.

DETAILED DESCRIPTION OF THE PREFERRED EMBODIMENTS

Figure 1:
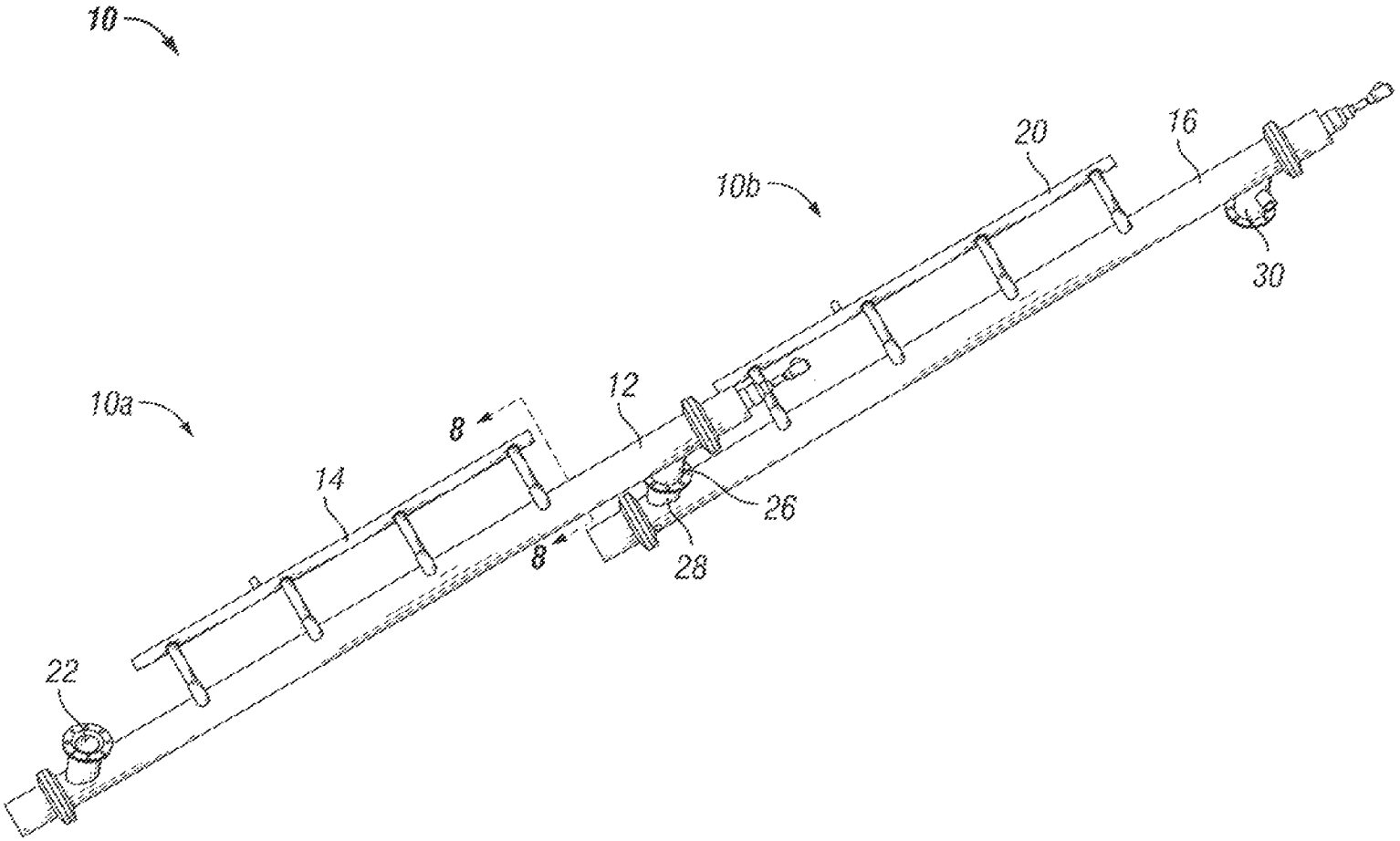
FIG. 1 is a side view of cooler assembly according to an embodiment of the present invention.

In FIG. 1, there is depicted a cooler assembly 10 according to an embodiment of the present invention, including first cooling portion 10*a*, and a second cooling portion 10*b*. The first cooling portion 10*a* includes a first housing 12 having a first exhaust port 14, and the second cooling portion 10*b* includes a second housing 16 having a second exhaust port 20. The first cooling portion 10*a* has an inlet 22 for receiving product from a distillation unit (not shown). The inlet 22 provides a passage for the product to enter a first cooling chamber 24 (best shown in FIGS. 6A and 6B). The first cooling portion 10*a* also has an outlet 26 for discharging the product after the product passes through the first cooling chamber 24. Similarly, the second cooling portion 10*b* has an inlet 28 that can be connected to the outlet 26 of the first cooling portion 10*a*, and that receives product from the first cooling chamber 24 into a second cooling chamber 29 (shown in FIG. 4). The second cooling portion 10*b* further includes an outlet 30 for discharging product from the second cooling chamber 29. Although the inlets 22, 28 and outlets 26, 30 are shown in the figures to be of particular shapes, it is to be understood that any shape opening can be used for the inlets and outlets of the cooler housings.

Figure 3:
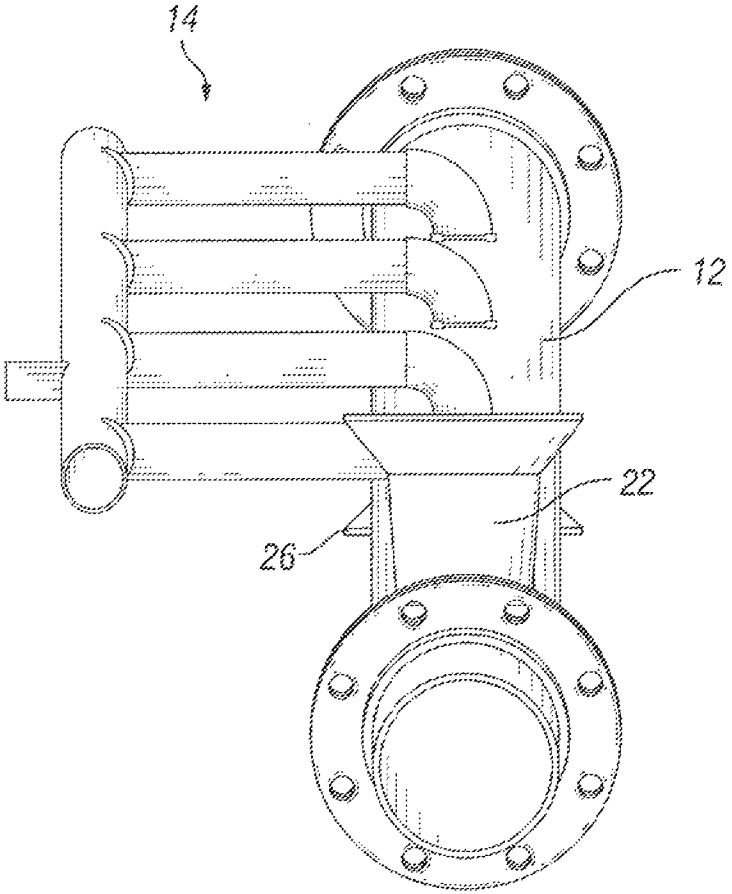
FIG. 3 is a rear view of a portion of the cooler assembly of FIG. 1.
Figure 2:
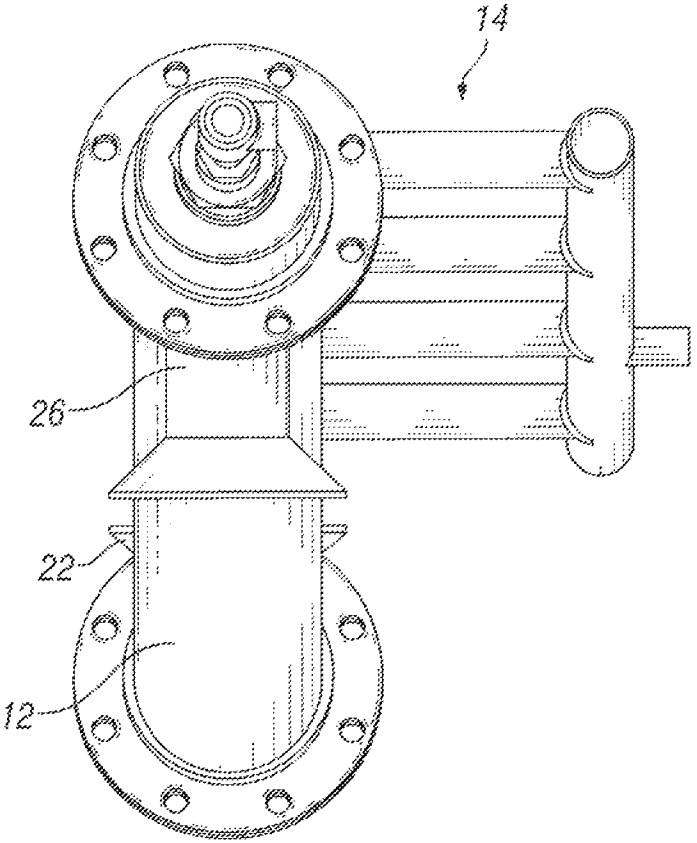
FIG. 2 is a front view of a portion of the cooler assembly of FIG. 1.

Although the embodiment of FIG. 1 shows a cooling assembly 10 having two separate cooling portions 10*a*, 10*b*, this is simply one possible embodiment. The cooling assembly 10 may also be provided with a single cooling portion having a single housing and a single cooling chamber, or more than two cooling portions with more than two cooling chambers. In addition, in the embodiment shown in FIG. 1, the housings 12, 16 of the cooler assembly 10 are shown to be tilted at an angle so that the inlets 22, 28 are lower than the outlets 26, 30. Although such an orientation can provide certain benefits to the cooler assembly, it is to be understood that the housings 12, 16 can be oriented at other angles. FIGS. 2 and 3 show front and rear views, respectively, of the first cooling portion 10*a* and its associated components.

Figure 4:
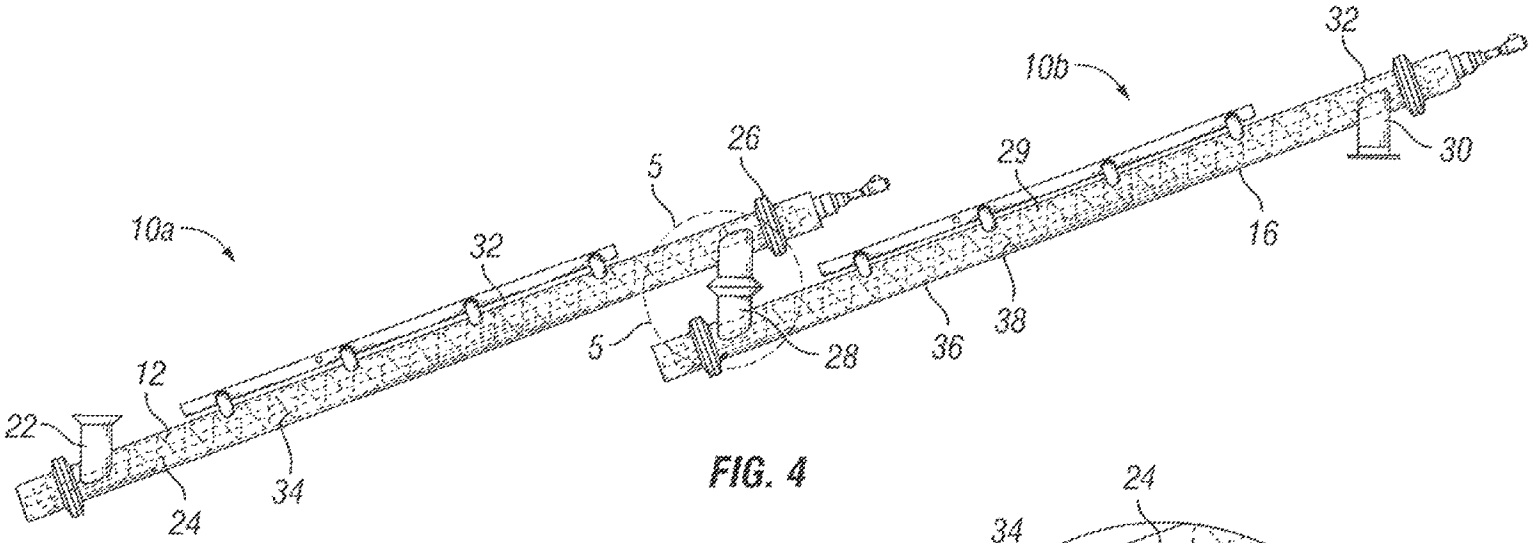
FIG. 4 is a side view of a cooler assembly according to an embodiment of the present invention and showing augers within the cooler assembly.

FIG. 4 shows an alternate view of the cooler assembly 10, including the first cooling portion 10*a* and the second cooling portion 10*b*. The first cooling portion includes a first housing 12 that surrounds a first inner tube 32. The first inner tube 32 encloses the first cooling chamber 24, and an auger 34 extends across the length of the first cooling chamber 24. Similarly, the second cooling portion includes the second housing 16, which encloses a second inner tube 36. The second inner tube 36 encloses the second cooling chamber 29, and an auger 38 extends across the length of the second cooling chamber 29.

In practice, product is fed, by gravity or otherwise, into the inlet 22 of the first cooling portion 10*a*, and passes through the first housing 12 into the first cooling chamber 24. In the first cooling chamber 24, the auger 34 turns, and the helical blades of the auger 34 transport the product from the inlet 22 to the outlet 26 at an opposite end of the first cooling portion 10*a*. At the outlet 26, the product exits the first cooling chamber 24, and drops through the outlet 26 into the inlet 28 of the second cooling portion 10*b*. The inlet 28 of the second cooling portion 10*b* guides the product through the second housing 16 and into the second cooling chamber 29. In the second cooling chamber 29, the auger 38 turns, and the helical blades of the auger 38 transport the product from the inlet 28 to the outlet 30 at an opposite end of the second cooling portion 10*b*. At the outlet 30, the product exits the second cooling chamber 29.

Figure 5:
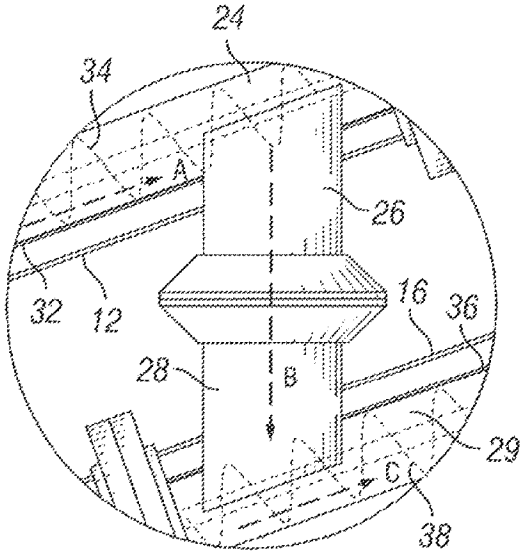
FIG. 5 is an enlarged side view of a portion of the cooler assembly of FIG. 4.

FIG. 5 shows an enlarged view of the outlet 26 of the first cooling portion 10*a* and the inlet 28 of the second cooling portion 10*b*, to illustrate how the first cooling chamber 24 is connected to the second cooling chamber 29. Specifically, as the auger 34 of the first cooling chamber 24 turns it drives product through the first cooling portion 10*a* in the direction of arrow A. As the product reaches the outlet 26 of the first cooling portion 10*a*, it drops through the outlet 26 and into the inlet 28 of the second cooling portion 10*b* in the direction of arrow B. The inlet 28 of the second cooling portion 10*b* guides the product directly to the auger 38, which turns to drive the product through the second cooling chamber 29 in the direction indicated by arrow C.

Figure 6A:
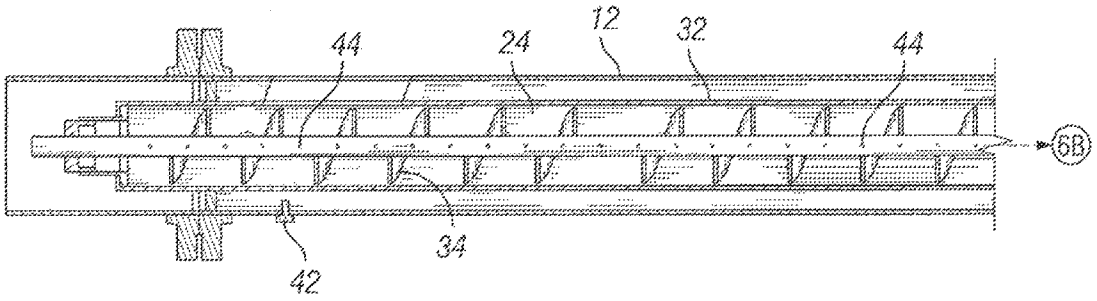
FIG. 6A is an enlarged side cross-sectional view of a portion of a cooler assembly according to an embodiment of the present invention.
Figure 6B:
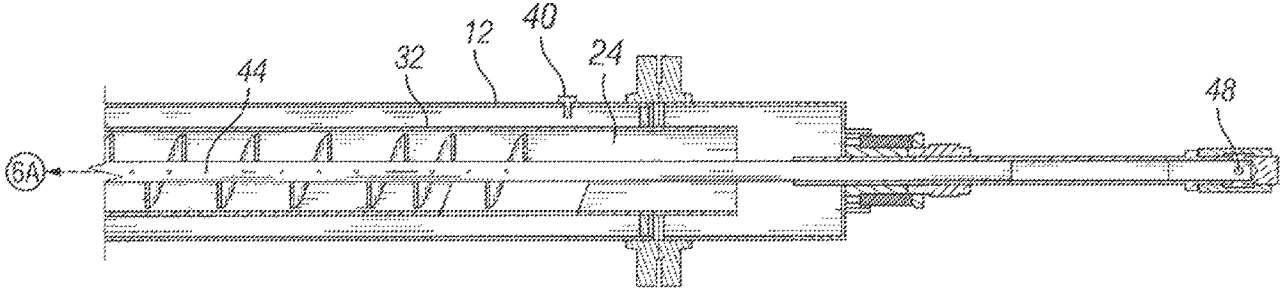
FIG. 6B is an alternate enlarged side cross-sectional view of the portion of the cooler assembly of FIG. 6A.

FIGS. 6A and 6B show an enlarged side cross-sectional view of the first cooling section 10*a*, including some example components that perform cooling functions. As the product is driven through the first cooling section 10*a*, there are at least two ways that the product is cooled. A first way is by means of cooling fluid inside the housing 12, but outside the inner tube 32. In the embodiment shown, this cooling fluid can be injected into the housing 12 via an inlet valve 40. After circulating around the inner tube 32 to the opposite end of the housing 12, the fluid can then be ejected from the housing 12 via an outlet valve 42. The flow of cooling fluid around the inner tube 32 acts as a heat exchanger, with heat from the product being transferred to the fluid as it flows from the inlet valve 40 to the outlet valve 42.

After the fluid exits the housing 12 through the outlet valve 42, it can be cooled and recirculated back into the inlet valve 40, thereby creating a closed loop system. In this way, a constant flow of cooling fluid can be moved through the housing 12, thereby continuously cooling the product in the cooling chamber 24. In alternate embodiments, the fluid exiting the outlet valve 42 can be disposed of, and new cooling fluid can be injected into the housing 12 via the inlet valve 40. Any appropriate cooling fluid can be used in the housing 12 to help cool the product, including water.

Figure 7:
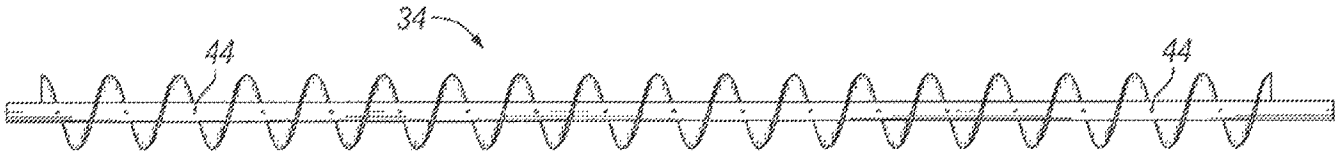
FIG. 7 is a side view of an auger according to an embodiment of the present invention.
Figure 8:
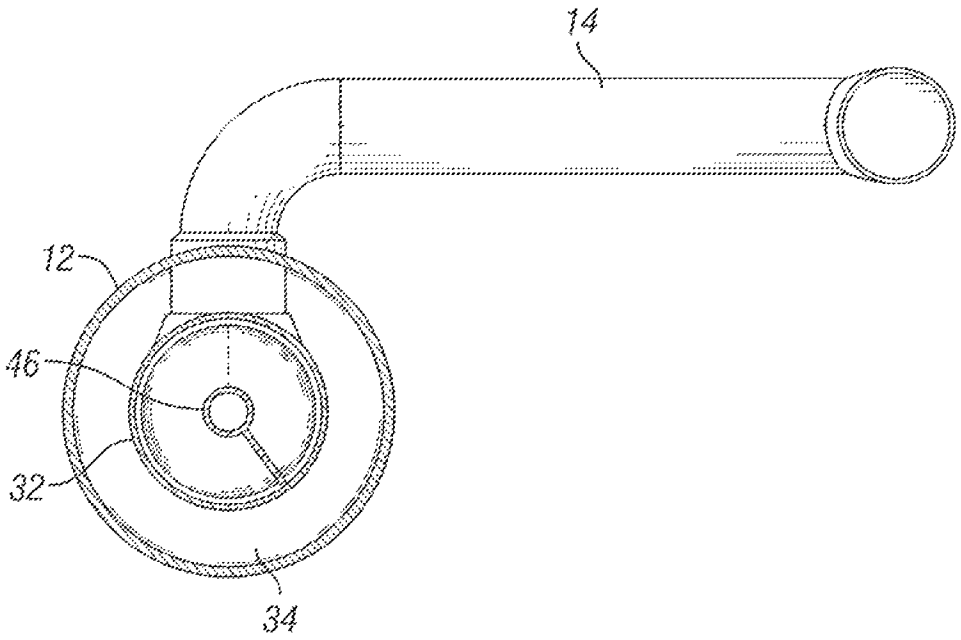
FIG. 8 is a cross-sectional view of a portion of the cooler assembly of FIG. 1 taken along the line 8-8 of FIG. 1.

The product can also be cooled by means of cool gas injected directly into the cooling chamber and mixed with the product. For example, FIG. 7 shows the auger 34, according to an embodiment of the invention, including gas injection holes 44. In addition, FIG. 8 shows a cross-sectional view of the first cooling section 10*a*, including the auger 34 within the inner tube 34, which includes a hollow shaft 46. As the auger 34 rotates in the cooling chamber 24, a cooling gas can be injected into the hollow shaft 46 of the auger 34 via an auger inlet valve 48 (shown in FIG. 6B). The cooling gas travels through the hollow shaft 46 along the length of the auger shaft, and exits the gas injection holes 44 into the cooling chamber 24. When the cooling gas enters the cooling chamber 24, it mixes with the product, thereby helping to cool the product.

Also shown in FIG. 8 is the exhaust port 14. The exhaust port 14 extends through the housing 12 and attaches to the inner tube 32. As the cooling gas enters the cooling chamber 24, and begins to cool the product, exhaust gases are purged from the cooling chamber 24 through the exhaust port 14. Accordingly, the exhaust port 14 provides a vent for the hot gases to escape as the cooling chamber 24 as the product cools. The exhaust port 14 may be sealingly attached to the inner tube 32 to prevent cooling liquid inside the housing 12 from entering the cooling chamber 24.

Simultaneous use of the different cooling techniques described herein provides advantages over known cooling methods because the dual cooling techniques act together to cool the product faster. It is to be understood, however, that either technique may be used individually without departing from the spirit and scope of the invention. In addition, any of the cooling techniques described herein could be combined with other known cooling techniques to decrease cooling times and increase the efficiency of the cooler assembly 10.

In addition, the specific cooling techniques described herein are described in relation to a single cooling section 10*a*. Some embodiments of the invention, however, contemplate the use of both cooling techniques in more than one cooling section. For example, both techniques can be utilized in the second cooling section 10*b*. In embodiments where both the first and second cooling sections 10*a* and 10*b* are used together, use of both cooling techniques provides substantial benefits and introduces greater efficiency to the cooler assembly 10 as a whole.

Additional embodiments of the invention include a process for cooling product using the above-described cooler assembly. According to the process, product is inserted into the cooling chamber 24 of the first cooling section 10*a* through the inlet 22 thereof. Inside the first cooling chamber 24, the product is driven by a first auger 34 that has a helical blade circumscribing a hollow shaft 46.

As the product is driven through the first cooling chamber 24 by the first auger 34, cool gas can be injected into the cooling chamber 24 through perforations, or injection holes 44, in the shaft. The cool gas can then mix with the product to help cool the product. As cool gas is injected into the cooling chamber 24, hot gases can be vented from the cooling chamber through an exhaust port 14. In some embodiments, the gas exiting the exhaust port can be captured and re-cooled, after which it can be recirculated back into the chamber.

Also as the product is driven through the first cooling chamber 24, cooling fluid can be circulated through the housing 12 surrounding the inner tube 32 that encloses the cooling chamber 24. This cooling fluid can act as a heat exchanger, transferring heat from the product to the cooling fluid. Use of this cooling method along with the direct injection of cool gas within the cooling chamber 24 increases the efficiency of the cooler assembly 10 and decreases the cooling time of the product. After the cooling fluid has been circulated through the housing 12, it can be cooled and recirculated back into the housing for further cooling.

After the product is driven through the cooling chamber 24, it is discharged from the cooling chamber 24 through the outlet 26 thereof. From there, in some embodiments, the product is fed into a second cooling chamber 29 through a second inlet 28. Inside the second cooling chamber 29, the product is driven by a second auger 38 that has a helical blade circumscribing a hollow shaft.

As the product is driven through the second cooling chamber 29 by the second auger 38, cool gas can be injected into the cooling chamber 29 through perforations, or injection holes, in the shaft. The cool gas can then mix with the product to help cool the product. As cool gas is injected into the cooling chamber 29, hot gases can be vented from the cooling chamber through a second exhaust port 20. In some embodiments, the gas exiting the second exhaust port 20 can be captured and re-cooled, after which it can be recirculated back into the chamber.

Also as the product is driven through the second cooling chamber 29, cooling fluid can be circulated through the second housing 16 surrounding the second inner tube 36 that encloses the second cooling chamber 29. This cooling fluid can act as a heat exchanger, transferring heat from the product to the cooling fluid. Use of this cooling method along with the direct injection of cool gas within the second cooling chamber 29 increases the efficiency of the cooler assembly 10 and decreases the cooling time of the product. After the cooling fluid has been circulated through the second housing 16, it can be cooled and recirculated back into the housing for further cooling. After the product is driven through the second cooling chamber 29, it is discharged from the second cooling chamber 29 through the outlet 30 thereof.

The invention has been sufficiently described so that a person with average knowledge in the matter may reproduce and obtain the results mentioned in the invention herein. Nonetheless, any skilled person in the field of technique, subject of the invention herein, may carry out modifications not described in the request herein, to apply these modifications to a determined structure, or in the manufacturing process of the same, requires the claimed matter in the following claims; such structures shall be covered within the scope of the invention.

It should be noted and understood that there can be improvements and modifications made of the present invention described in detail above without departing from the spirit or scope of the invention as set forth in the accompanying claims.

What is claimed is:

1. An apparatus for cooling product, the apparatus comprising:

first and second cooling chambers connected to each other and configured to pass the product from the first cooling chamber to the second cooling chamber;

first and second augers, positioned within the first and second cooling chambers, respectively, the first auger having a first helical blade for driving the product through the chamber, the first helical blade surrounding a first perforated hollow shaft configured to transmit cool gas as a first coolant into the first cooling chamber through the first shaft, the second auger having a second helical blade for driving the product through the second cooling chamber, the second helical blade surrounding a second perforated hollow shaft configured to transmit the first coolant into the second cooling chamber through the second shaft, the first perforated hollow shaft defining a first longitudinal axis proceeding along the length of the first perforated hollow shaft, and the second perforated hollow shaft defining a second longitudinal axis proceeding along the length of the second perforated hollow shaft;

a first outer housing disposed around the first cooling chamber forming a first hollow space between the first cooling chamber and the first outer housing, through which a second coolant configured to be passed so that the first cooling chamber acts as a heat exchanger for cooling the product within the first cooling chamber;

a second outer housing disposed around the second cooling chamber forming a second hollow space between the second cooling chamber and the second outer housing, through which the second coolant configured to be passed so that the second cooling chamber acts as a heat exchanger for cooling the product within the second cooling chamber;

a first plurality of exhaust ports, sealingly engaged with the first cooling chamber configured to permit warmed first coolant to escape from the first cooling chamber, the first plurality of exhaust ports disposed and spaced apart at more than one location along the first longitudinal axis configured to vent the warmed first coolant away from the first auger, wherein a portion of the first plurality of exhaust ports is disposed within the first hollow space, the portion of the first plurality of exhaust ports disposed within the first hollow space; and a second plurality of exhaust ports, sealingly engaged with the second cooling chamber configured to permit warmed first coolant to escape from the second cooling chamber, the second plurality of exhaust ports disposed and spaced apart at more than one location along the second longitudinal axis configured to vent the warmed first coolant away from the second auger, wherein a portion of the second plurality of exhaust ports is disposed within the second hollow space, the portion of the second plurality of exhaust ports disposed within the second hollow space.

* * * * *